US007438356B2

(12) United States Patent
Howman et al.

(10) Patent No.: US 7,438,356 B2
(45) Date of Patent: Oct. 21, 2008

(54) PORTABLE HEATED STADIUM SEAT AND METHOD

(75) Inventors: John R. Howman, Grafton, WI (US); Bruce E. Schmidt, Maribel, WI (US)

(73) Assignee: Tranquilease, LLC, Milwaukee, WI (US)

( * ) Notice: Subject to any disclaimer, the term of this patent is extended or adjusted under 35 U.S.C. 154(b) by 0 days.

(21) Appl. No.: 11/321,436

(22) Filed: Dec. 29, 2005

(65) Prior Publication Data

US 2007/0152479 A1 Jul. 5, 2007

(51) Int. Cl.
*A47C 7/74* (2006.01)
*A47C 15/00* (2006.01)

(52) U.S. Cl. ..... 297/180.11; 297/17; 297/229; 297/352

(58) Field of Classification Search ..... 297/180.11, 297/17, 252, 352, 228.1, 228.11, 228.12, 297/229, 230.1, 230.11, 230.12, 230.13
See application file for complete search history.

(56) References Cited

U.S. PATENT DOCUMENTS 2,712,592 A * 7/1955 Goldstein et al. ... 297/180.11 X
2,731,542 A * 1/1956 Daniels ..... 297/180.11 X
3,136,577 A * 6/1964 Richard ..... 297/180.11
4,335,725 A * 6/1982 Geldmacher ..... 297/180.11 X
4,413,857 A * 11/1983 Hayashi ..... 297/180.11
4,561,441 A * 12/1985 Kolodziej ..... 297/180.11 X
4,592,345 A * 6/1986 Wahl ..... 297/230.12 X
4,604,987 A 8/1986 Keitner
4,793,651 A * 12/1988 Inagaki et al. ..... 297/180.11
4,889,383 A * 12/1989 Jones ..... 297/17 X
5,034,594 A 7/1991 Beezhold et al.
5,067,771 A * 11/1991 Ellis ..... 297/180.11 X
5,398,667 A 3/1995 Witt
5,516,189 A * 5/1996 Ligeras ..... 297/180.11
5,516,193 A 5/1996 Simpson
5,545,198 A 8/1996 Owens
5,613,730 A * 3/1997 Buie et al. ..... 297/180.11
5,816,463 A 10/1998 Echeverri
5,833,309 A * 11/1998 Schmitz ..... 297/180.11
5,915,783 A 6/1999 McDowell et al.
6,073,998 A 6/2000 Siarkowski et al.
6,109,256 A 8/2000 Sardi
6,220,659 B1 4/2001 McDowell et al.
6,502,902 B1 1/2003 Romero
6,848,746 B2 * 2/2005 Gentry ..... 297/180.11 X
2004/0069792 A1 4/2004 Yoneyama et al.
2004/0195227 A1 10/2004 Park
2005/0168028 A1 8/2005 Seibt

* cited by examiner

*Primary Examiner*—Rodney B. White
(74) *Attorney, Agent, or Firm*—Reinhart Boerner Van Deuren s.c.

(57) ABSTRACT

A portable stadium seat having a base and a back for use on bleacher or hard plastic seating is disclosed which has heated seat and backrest members and a self-contained, rechargeable electrical power source for operating an electrical heating element contained in each of the seat and backrest members. The backrest member is hingedly mounted on the seat member, such that it may be folded flat onto the seat member for ease of portability and storage, and the portable heated stadium seat includes a carrying strap to enhance the portability of the portable heated stadium seat. An external recharger is used to charge the batteries prior to use, with the portable heated stadium seat thus being useable in locations where electrical power is not easily accessible.

27 Claims, 4 Drawing Sheets

PORTABLE HEATED STADIUM SEAT AND METHOD

BACKGROUND OF THE INVENTION

Field of the Invention

The present invention relates generally to a portable stadium seat having a seat and a backrest for use on bleacher or hard plastic seating, and more particularly to a portable stadium seat having heated seat and backrest members with a self-contained, rechargeable power source for operating heating elements contained in the seat and backrest members.

For some time, attendance of sporting and other activities at outdoor venues has been a popular pastime not just in the summer but in the spring, the fall, and even during the early winter season. Typically, large outdoor venues have either bleachers or hard, plastic seats, neither of which are particularly comfortable, especially in cool or cold weather. While blankets have been used since the advent of attendance at outdoor sporting activities, increasingly portable stadium seats have been used.

Portable stadium seats typically include a seat or base member and a backrest member which is pivotally attached to the seat member to allow it to be folded against the seat member for convenience of portability and storage. Many portable stadium seats include padded seats, and some also include padded backrests. Many of these portable stadium seats are mounted upon a hard tubular frame, typically made of bent aluminum tubing. While these portable stadium seats work quite well on bleachers, they do not work as well on molded hard plastic seats due to the presence of the frame on the bottom of the portable stadium seat.

More recently, portable stadium seats which are not based upon hard tubular frames have become popular. These portable stadium seats have seat and backrest members, and typically rely on the use of straps located on each side of the portable stadium seats which each extend between the front of the seat member and the top of the backrest member to maintain the backrest member in an upright position when a user of the portable stadium seat is sitting in the seat. Such portable stadium seats have the advantage that they can be used both with bleachers seating and with molded hard plastic seats.

Perhaps the biggest single downside of most portable stadium seats is that while they provide an increased level or comfort over bleachers or molded hard plastic seats, they do not remedy the chill of sitting in an outdoor stadium in cool or cold weather. Thus, many people attending outdoor events in cool or cold weather must bring a blanket in addition to such portable sport seats to the event. As might be expected, the art indicates that this problem has been recognized and addressed in the past. In fact, there are no less than four different technologies which have been suggested as solutions to the problem of heating portable sports seats.

U.S. Pat. No. 4,604,987, to Keltner, discloses a portable heated stadium seat cushion having a pocket which utilizes an air-activated chemical heating packet which is inserted into the stadium seat cushion. The Keltner device has several disadvantages, most notably the requirement to purchase chemical heating packets each time the heating feature is used. In addition, the degree of heating provided is nonadjustable. Further, the Keltner device does not have a backrest.

U.S. Pat. No. 5,545,198, to Owens, discloses a portable heated stadium seat utilizing a microwaveable heating pad which is inserted into the seat member of the portable stadium seat. The Owens device has several disadvantages, most notably that sports stadiums do not have microwave ovens to heat the microwaveable heating pad. Accordingly, the microwaveable heating pad must be heated prior to the user leaving his or her home. Additionally, the microwaveable heating pad contains liquid, and is thus subject to rupturing, and the degree of heating provided is nonadjustable. Finally, the Owens device heats only the seat member and not the backrest member.

U.S. patent No. to Sardi discloses a heated cushion which has a container located inside the body of the heated cushion. Like a hot water bottle, the container is filled with hot water, which is the source of heating for the Sardi device. Aside from the fact that it can be rather difficult to fill the container at a sports stadium, the Sardi device also possesses the disadvantage of containing liquid and thereby being subject to bursting, and the further disadvantage that the degree of heating provided is nonadjustable. Further, the Sardi device does not have a backrest.

The other approach has more potential, in that it uses electricity to drive a heating element contained in the device. U.S. Pat. No. 5,034,594, to Beezhold et al., discloses a seat cushion heated by an electrical resistance heating element. The Beezhold et al. device has no back, and requires the user to purchase batteries each time the device is to be used. While it has an on/off switch, there is no other way of controlling the degree of heating which is provided. Further, the Beezhold et al. device does not have a backrest.

U.S. Pat. Nos. 5,915,783 and 6,220,659, both to McDowell et al., disclose stadium seats which are designed to have a removable seat cushion assembly and a seat back assembly installed therein. Both the seat cushion assembly and the seat back assembly include a heater insert which is powered by electrical connections built into the stadium seats. The McDowell et al. stadium seats are designed for premium seating areas, and have not been adopted by most of the sports stadiums at present. They are unduly complex and expensive, require that the seat be pre-wired, and that are not particularly portable since they will be owned by the stadium and not by individuals.

It is accordingly the primary objective of the present invention that it provide a portable stadium seat that has both a heated seat member and a heated backrest member. It is a related objective of the present invention that the degree of heating in the seat member and the backrest member be consistent and that it not begin operation at a high level of temperature and subsequently and continually decline in temperature over time. It is another primary objective of the present invention that heat be generated in the seat member and the backrest member of the portable heated stadium seat by a self-contained power source rather than by an external power source.

It is further objective of the present invention that it utilize a power source which is reusable on a large number of occasions and which thereby does not require replacement. It is yet another objective of the present invention that the portable heated stadium seat be both foldable and lightweight to thereby make it easily portable as well as commercially desirable. It is still another objective of the present invention that the portable heated stadium seat have a configuration which will work well both on bleachers and on molded hard plastic seats.

The portable heated stadium seat of the present invention must also be of construction which is both durable and long lasting, and it should also require little or no maintenance to be provided by the user throughout its operating lifetime. In order to enhance the market appeal of the portable heated stadium seat of the present invention, it should also be of inexpensive construction to thereby afford it the broadest possible market. Finally, it is also an objective that all of the aforesaid advantages and objectives of the portable heated stadium seat of the present invention be achieved without incurring any substantial relative disadvantage.

SUMMARY OF THE INVENTION

The disadvantages and limitations of the background art discussed above are overcome by the present invention. With this invention, a portable heated stadium seat having a seat member and a backrest member is provided. The backrest member is hingedly mounted on the seat member, such that it may be folded flat onto the seat member for ease of portability and storage. The top of the backrest member is connected with support straps on the right and left sides thereof to the front of the seat member on the right and left sides thereof, with the support straps preventing the backrest member from collapsing rearwardly and thereby supporting the backrest member when the portable heated stadium seat is in use.

Each of the seat member and the backrest member of the portable heated stadium seat has a frame member contained therein. In a first embodiment, the seat frame member and the backrest frame member are both made of a thin solid plywood or fiberboard material, with the seat frame member being flat and the backrest frame member being contoured. In a second embodiment which is the currently preferred embodiment, both the seat frame member and the backrest frame member are made of an aluminum tubular construction. The seat frame member and the backrest frame member are hingedly connected together to facilitate the folding of the backrest member onto the seat member. The top side of the seat frame member and the front side of the backrest frame member have foam cushions mounted thereon, and the bottom side of the seat frame member and the back side of the backrest frame member preferably also have a thin nonwoven fabric pad mounted thereon.

Thin heating elements are placed on top of the foam cushion on the seat member and in front of the foam cushion on the backrest member. Each of the heating elements is a resistance wire array mounted intermediate front and back covers, and such heating elements are well known to those skilled in the art and are available from a wide array of manufacturers. In the preferred embodiment, thin nonwoven fabric pads are located between the heating elements and the foam cushions.

A battery pack is mounted on front of the backrest frame member near the bottom thereof, under the bottommost edge of the foam cushion mounted on the backrest frame member. The heating elements are wired together in series (although they could instead be wired in parallel), and the wires from the heating elements and the battery pack extend upwardly on the back side of the backrest frame member.

Thin foam cushions are located on top of the heating element located on the seat member and in front of the heating element located in the backrest member. The portable heated stadium seat is encased in a heavy-duty woven fabric including front and back cover segments which are sewn together at the edges thereof. The support straps are sewn into the cover segments, as is a handle for carrying the portable heated stadium seat which may be connected to the backrest member at the top thereof at the right and left sides thereof. A fastening strap is also sewn onto the rear cover segment at a location near the top of the backrest member at the back side thereof, and has a first mating strip for removable connection to a second mating strip which is sewn onto the rear cover segment at a location near the front of the seat member at the bottom side thereof.

A pocket may be located on the rear side of the backrest member (or in any other position, such as on the front side of the backrest member near the lower right side thereof), and the wires from the heating elements and the battery are routed into the interior of this pocket. An on/off control is stored in the pocket, as is a connector to which a battery charger may be removably connected to charge the battery pack. By turning the on/off control on, the battery pack will be connected to the heating elements to heat the top side of the seat member and the front side of the backrest member. In the preferred embodiment, a thermostat is used to control the degree of heating provided. Optionally, a pressure switch may be used to prevent the heating elements from being energized unless a user is sitting on the seat member.

Other embellishments which are optional include a strap or handle mounted on the portable heated stadium seat to facilitate carrying the portable heated stadium seat. The carrying strap can be located on the end of one of the seat member and the backrest member located furthest from their point of connection together, near the point of their connection together, or on one of the sides of one of the seat member and the backrest member. Another embellishment is the provision of a storage pocket which may be located on the portable heated stadium seat and a logo which may be located on the portable heated stadium seat. In the preferred embodiment, both the storage pocket and the logo are located on the back side of the backrest member. Additionally, the entire portable heated stadium seat may be made with exterior colors which are appropriate for various teams which are popular in areas in which the portable heated stadium seat will be sold.

It may therefore be seen that the present invention teaches a portable heated stadium seat that includes both a heated seat member and a heated backrest member. The degree of heating in the seat member and the backrest member of the portable heated stadium seat of the present invention is consistent and thus does not begin operation at a high level of temperature and subsequently and continually decline in temperature over time. Heat is generated in the seat member and the backrest member of the portable heated stadium seat of the present invention by a self-contained rechargeable electrical power source rather than by an external power source.

The portable heated stadium seat of the present invention utilizes a rechargeable electrical power source which is reusable on a large number of occasions and which thereby does not require replacement. The portable heated stadium seat of the present invention is both foldable and lightweight to thereby make it easily portable as well as commercially desirable. The portable heated stadium seat of the present invention has a configuration which works well both on bleachers and on molded hard plastic seats.

The portable heated stadium seat of the present invention is of a construction which is both durable and long lasting, and which will require little or no maintenance to be provided by the user throughout its operating lifetime. The portable heated stadium seat of the present invention is also of inexpensive construction to enhance its market appeal and to thereby afford it the broadest possible market. Finally, all of the aforesaid advantages and objectives of the portable heated stadium seat of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
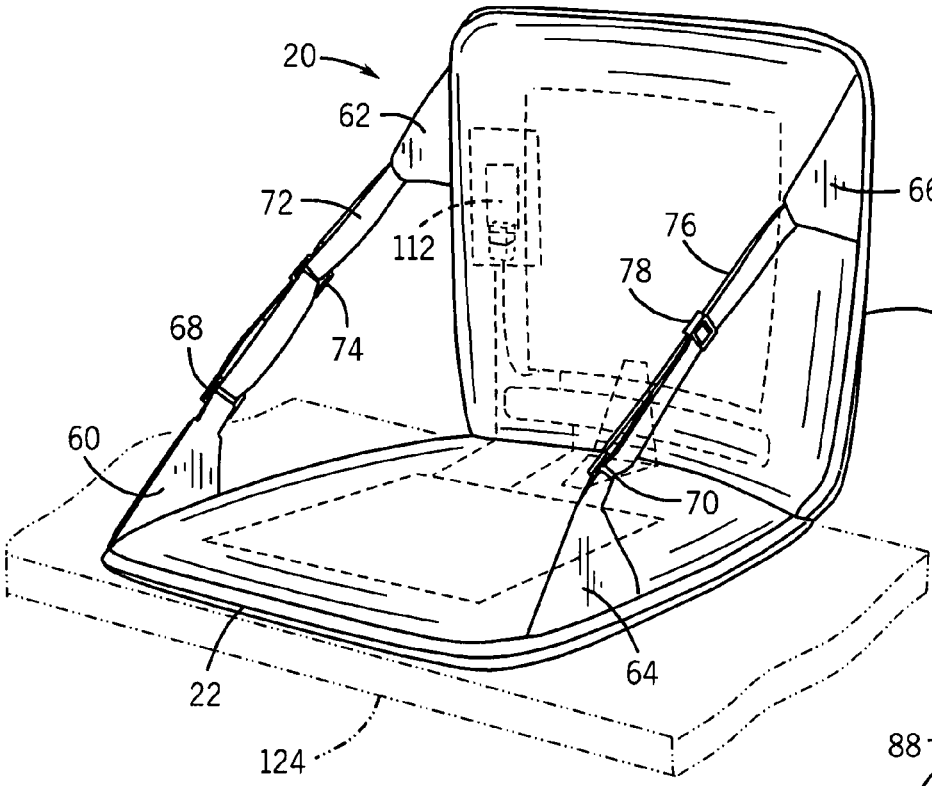
FIG. 1 is an isometric view of the portable heated stadium seat of the present invention shown from the front and left side thereof in its opened position on a bleacher.
Figure 2:
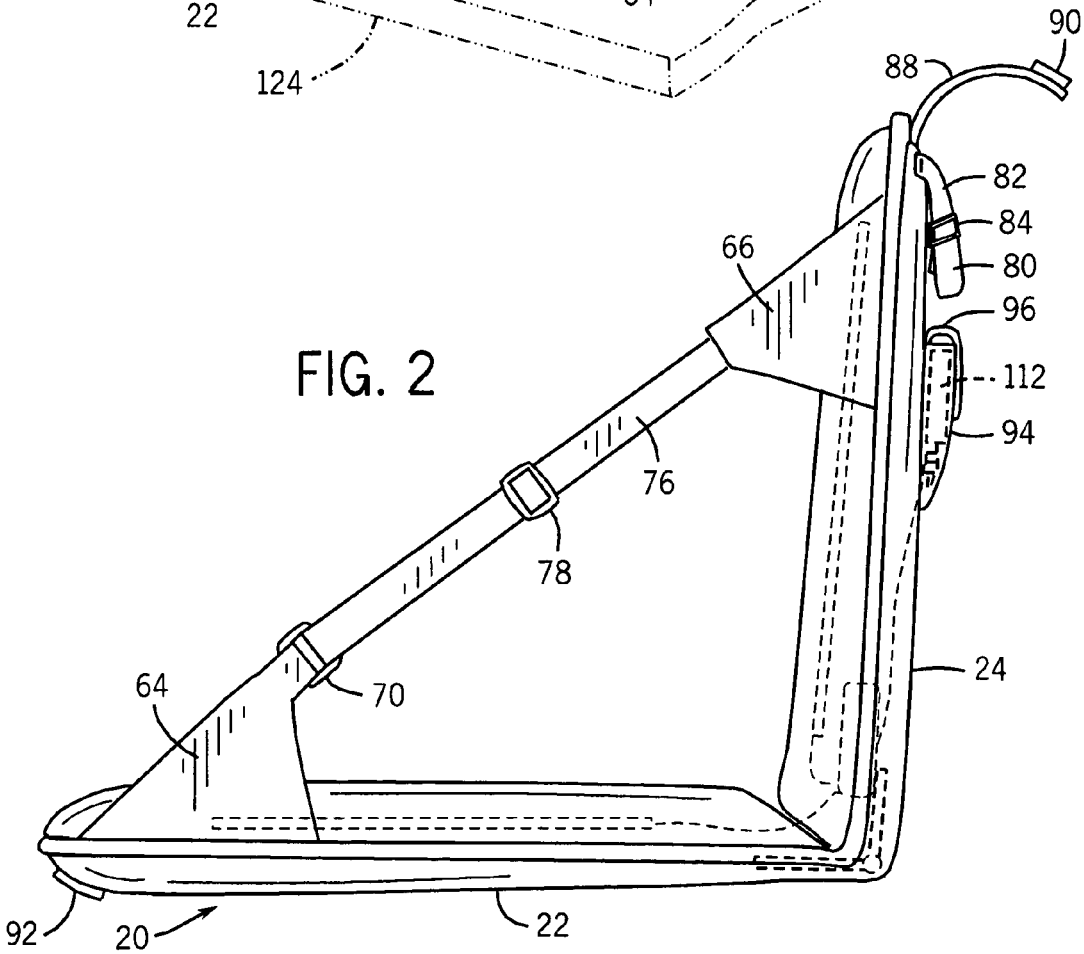
FIG. 2 is a side plan view of the portable heated stadium seat illustrated in FIG. 1.

The portable heated stadium seat of the present invention is shown in FIGS. 1 though 4, which depict a portable heated stadium seat 20 having a seat member 22 and a backrest member 24. It will be appreciated by those skilled in the art that many of the details of the construction of the portable heated stadium seat 20 can be varied without departing from the spirit of the present invention. Accordingly, it will be understood that the exemplary details of construction shown in the figures and discussed herein may be varied without in any way departing from the spirit of the present invention.

Figure 5:
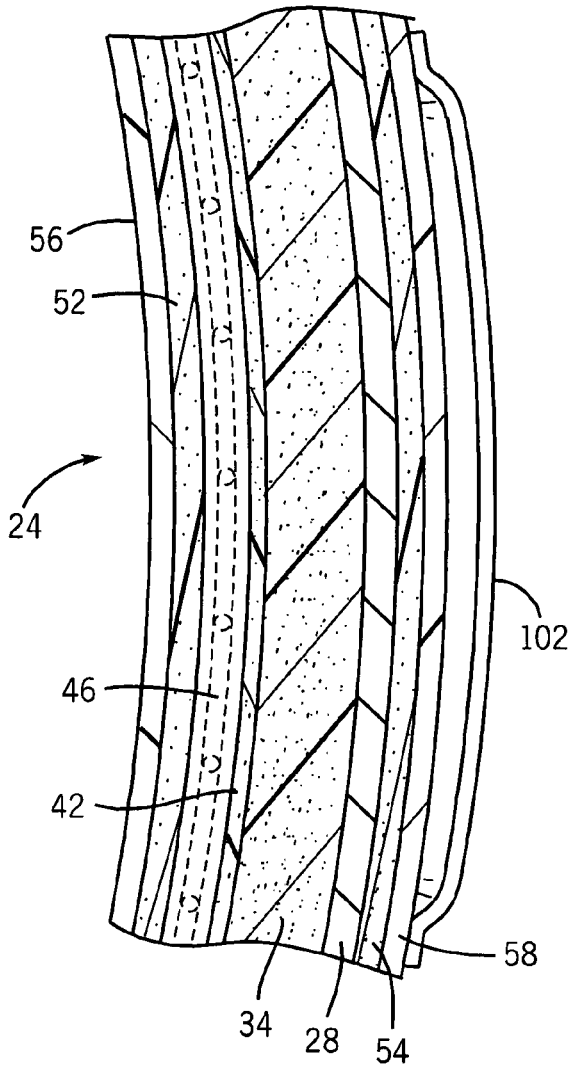
FIG. 5 is a partial cross-sectional view of the backrest of the portable heated stadium seat illustrated in FIGS. 1 through 4, showing the curvature of the back portion thereof.

The portable heated stadium seat 20 is constructed around a seat frame member 26 and a backrest frame member 28, both of which are of relatively rigid but lightweight construction. In a first embodiment, the seat frame member 26 and the backrest frame member 28 are made of thin plywood or fiberboard. The backrest frame member 28 is contoured, as best shown in FIG. 5. The seat frame member 26 and the backrest frame member 28 are hingedly connected together with a hinge 30 which is centrally mounted at the rear edge of the seat frame member 26 and at the bottom edge of the backrest frame member 28. Those skilled in the art will understand that the hinge 30 has an offset design allowing the backrest frame member 28 to be folded onto the seat frame member 26 with adequate space therebetween to allow for the other components of the portable heated stadium seat 20 to fit therebetween.

Figure 4:
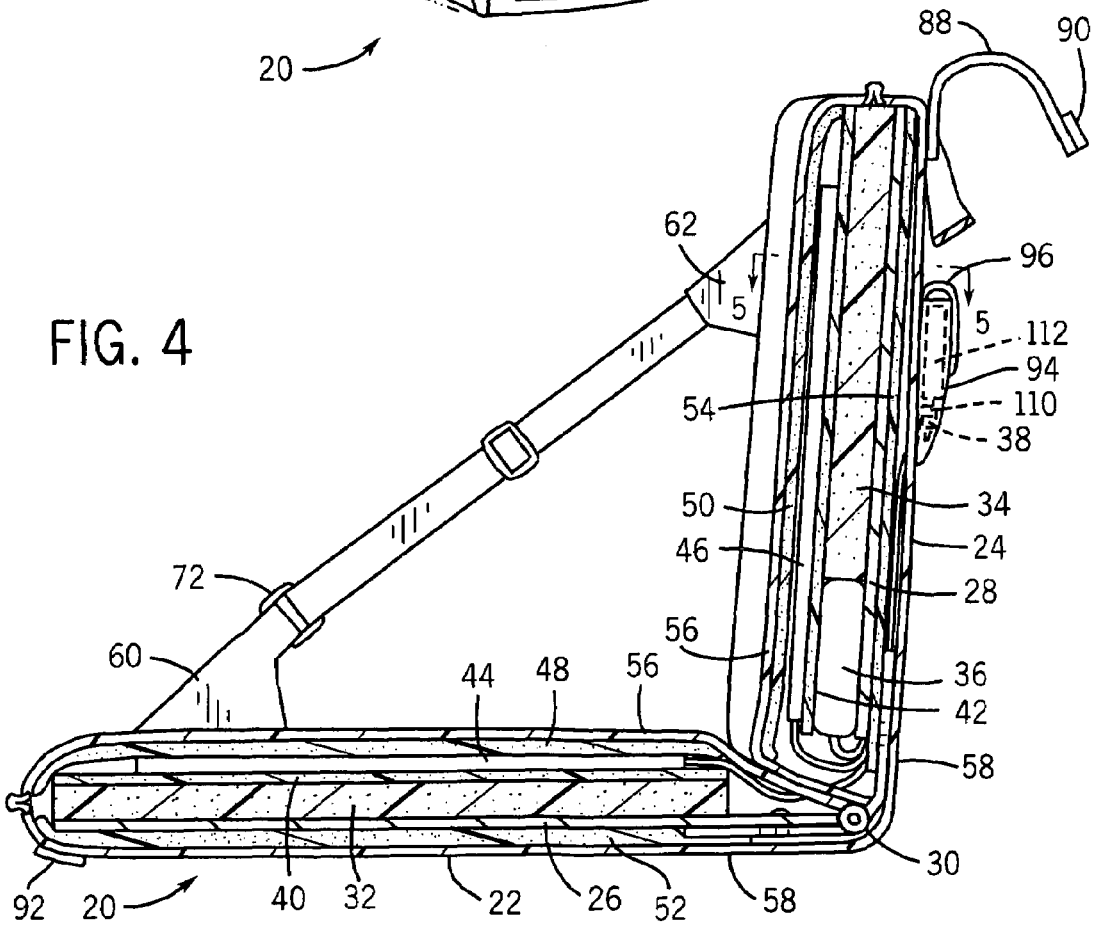
FIG. 4 is a cross-sectional side view of the portable heated stadium seat illustrated in FIGS. 1 through 3, showing a number of the internal components thereof.

Referring now primarily to FIG. 4, a foam cushion 32 is mounted on the top side of the seat frame member 26, and a foam cushion 34 is mounted on the front side of the backrest frame member 28. The foam cushions 32 and the backrest member 24 are approximately one inch thick, and are made of a resilient foam material. Note that the foam cushion 32 does not extend to the rear edge of the seat frame member 26, and that the foam cushion 34 does not extend to the bottom edge of the backrest frame member 28.

A battery pack 36 is horizontally oriented and mounted onto the front side of the backrest frame member 28 near the bottom thereof. The wires from the battery pack 36 are routed under the backrest frame member 28 and up the back side thereof, and they are connected to a female connector 38. In the preferred embodiment, the battery pack 36 may be made of nickel-cadmium (NiCad) batteries, which offer excellent performance for a reasonable cost.

The top side of the foam cushion 32 on the seat frame member 26 is covered with a thin nonwoven fabric pad 40, and the front side of the foam cushion 34 and the battery pack 36 on the backrest frame member 28 are covered with a thin nonwoven fabric pad 42. A thin, flat seat heating element 44 is located on top of the nonwoven fabric pad 40, and a thin, flat seat heating element 46 is located in front of the nonwoven fabric pad 42. The wires from the seat heating element 44 and the seat heating element 46 are routed under the backrest frame member 28 and up the back side thereof. In the preferred embodiment, the wires used in the seat heating elements 44 and 46 are 0.508 mm thick, have a resistance of 5.89 Ohms per meter, and each have approximately one meter of wire contained therein.

The top side of the seat heating element 44 of the seat member 22 is covered with a thin foam cushion 48, and the front side of the seat heating element 46 of the backrest member 24 is covered with a thin foam cushion 50. In the preferred embodiment, the bottom side of the seat frame member 26 is covered with a thin foam cushion 52, and the rear side of the backrest frame member 28 is covered with a thin foam cushion 54.

The portable heated stadium seat 20 is encased in a heavy-duty fabric enclosure including a front cover segment 56 which covers the top side of the seat member 22 and the front side of the backrest member 24, and a rear cover segment 58 which covers the bottom side of the seat member 22 and the rear side of the backrest member 24. The front cover segment 56 and the rear cover segment 58 may be made of ripstop synthetic material. The front cover segment 56 and the rear cover segment 58 are sewn together at their adjoining edges.

Referring now to FIGS. 1 through 4, it may be seen that four strap supports 60, 62, 64, and 66 are sewn into the seams between the front cover segment 56 and the rear cover segment 58. The strap support 60 is located at the right side of the seat member 22 near the front thereof, the strap support 62 is located at the right side of the backrest member 24 near the top thereof, the strap support 64 is located at the left side of the seat member 22 near the front thereof, and the strap support 66 is located at the left side of the backrest member 24 near the top thereof. A support ring 68 is sewn into the distal end of the strap support 60, and a support ring 70 is sewn into the distal end of the strap support 64.

One end of a support strap 72 is sewn onto the strap support 62, and the other end is looped through the support ring 68 and is sewn onto the middle of a buckle 74 which is slidably mounted on the portion of the support strap 72 between the strap support 60 and the strap support 62 to adjust the length between the strap support 62 and the strap support 60. Likewise, one end of a support strap 76 is sewn onto the strap support 66, and the other end is looped through the support ring 70 and is sewn onto the middle of a buckle 78 which is slidably mounted on the portion of the support strap 76 between the strap support 66 and the strap support 64 to adjust the length between the strap support 66 and the strap support 64.

One end of a carrying strap 80 is sewn into the seams between the front cover segment 56 and the rear cover segment 58 near the upper right corner of the backrest member 24. A short strap 82 is sewn into the seams between the front cover segment 56 and the rear cover segment 58 near the upper left corner of the backrest member 24. A support ring 84 is sewn into the distal end of the short strap 82. The other end of the carrying strap 80 is looped through the support ring 64 and is sewn onto the middle of a buckle 86 which is slidably mounted on the portion of the support strap 80 between the right and left sides of the backrest member 24 to adjust the length therebetween.

A fastening strap 88 is sewn at one end thereof to the rear cover segment 58 at a location at the back and near the top of the backrest member 24. The same side of the fastening strap 88 which is sewn at one end thereof to the rear cover segment 58 has a first mating strip 90 sewn thereon at the other end thereof. A second mating strip 92 is sewn onto the rear cover segment 58 at a location at the bottom and near the front of the seat member 22. When the backrest member 24 is folded onto the seat member 22, the fastening strap 88 is used to retain the seat member 22 and the backrest member 24 together by attaching the first and second mating strips 90 and 92 together.

In the preferred embodiment, the first and second mating strips 90 and 92 are mating male and female strips, best known as VELCRO-type strips (VELCRO being a trademark of Velcro Industries B.V. Ltd. Liab. Co.). The female strip is covered with curly strands or loops of material, and the male strip has a large number of flexible resilient plastic hooks thereon. When the male and female hooks are pressed against one another, the hooks in the male strip become entangled with the loops in the female strip, retaining the two strips together until they are forced apart. The force to separate the male and female strips is much higher than the force required to press them together.

Located on the back side of the backrest member 24 near the right side thereof is a control pocket 94 which is sewn onto the rear cover segment 58. The control pocket 94 has a flap 96 located at the top thereof which may be folded down to close the control pocket 94. A first mating strip 98 is mounted at the distal end of the flap 96, and a second mating strip 100 is mounted on the outside of the control pocket 94 near the top thereof. In the preferred embodiment, the first and second mating strips 98 and 100 are mating male and female VELCRO-type strips. The wires from the battery pack 36 and from the seat heating elements 44 and 46 pass through the rear cover segment 58 into the interior of the control pocket 94. Alternatively, the control pocket 94 may be located on the front side of the backrest member 24 at the right side thereof and near the bottom thereof.

Located on the back side of the backrest member 24 is a storage pocket 102 which is sewn onto the rear cover segment 58. In the preferred embodiment, the storage pocket 102 is a mesh pocket made of elastomeric mesh which will expand and contract as needed to securely hold objects therein. The storage pocket may open either at the top as shown, or at one side thereof. Also shown on the back side of the backrest member 24 is a logo 104 which may be, for example, a sports team name or a sports team logo. In the preferred embodiment, the portable heated stadium seat 20 may also be manufactured in the colors of the sports team.

Figure 6:
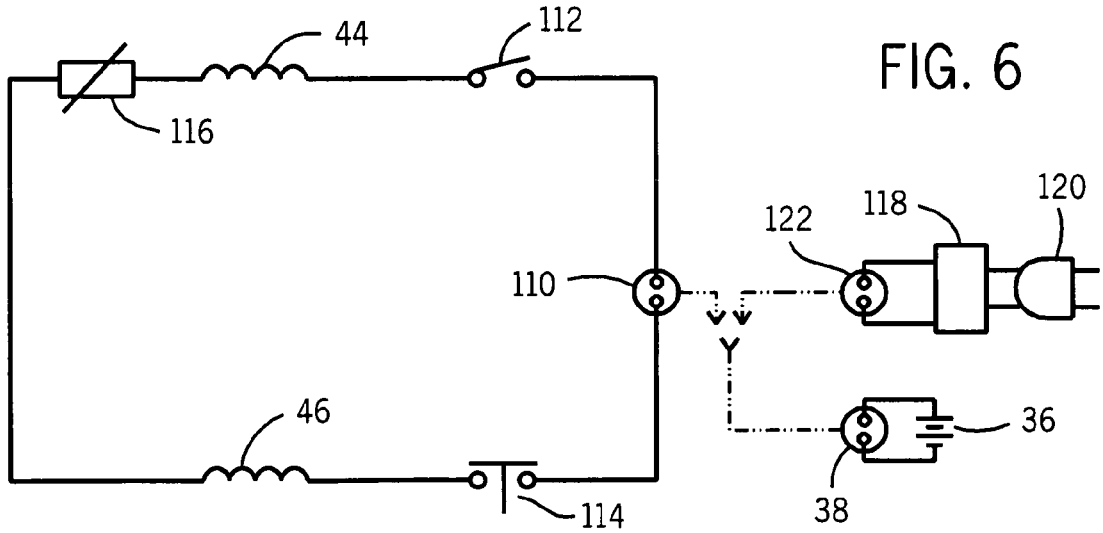
FIG. 6 is an electrical schematic of the portable heated stadium seat illustrated in FIGS. 1 through 5, also showing a battery charger used therewith.

Referring now to FIG. 6 in addition to FIGS. 1 through 5, an electrical schematic for the portable heated stadium seat 20 is illustrated. The female connector 38 from the battery pack 36 is removably electrically connected to a male connector 110. The male connector 110 is electrically connected in a series circuit with the seat heating elements 44 and 46, an on/off switch 112 (which may be, for example, a slide switch), an optional pressure switch 114, and a thermostat 116. (Note that alternatively the seat heating elements 44 and 46 could instead be connected in parallel.)

Figure 3:
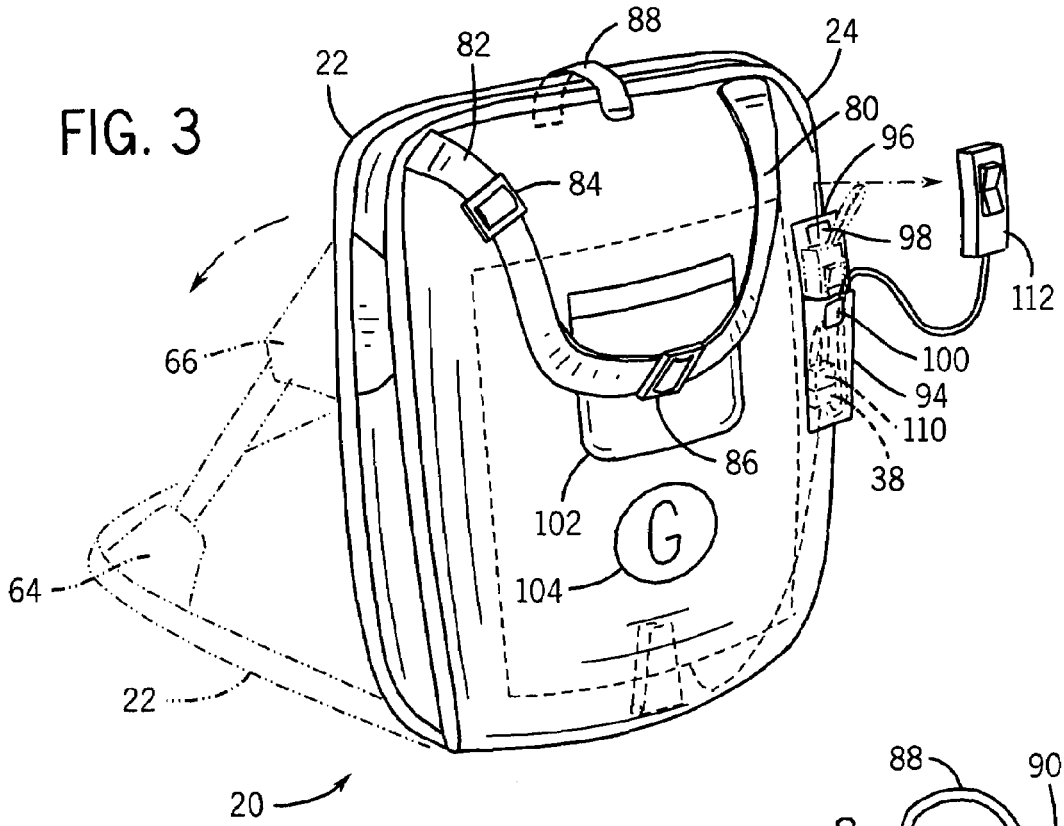
FIG. 3 is an isometric view of the portable heated stadium seat illustrated in FIGS. 1 and 2 shown from the rear and left side thereof in its closed position, also showing the on/off control thereof.

The on/off switch 112 is stored in the control pocket 94, as best shown in FIG. 3, and is used by the user of the portable heated stadium seat 20 to turn the seat heating elements 44 and 46 on and off. Optionally, a pressure switch 114 may be located in the seat member 22, and used to open the circuit and turn the seat heating elements 44 and 46 off when the user is not sitting on the seat member 22. The thermostat 116 is also preferably located in the seat member 22, and is used to turn the seat heating elements 44 and 46 on and off automatically to moderate the temperature. The thermostat 116 of the preferred embodiment turns seat heating elements 44 and 46 off when the temperature reaches fifty-five degrees Centigrade, and turns the seat heating elements 44 and 46 back on when the temperature drops to forty degrees Centigrade.

Both the female connector 38 and the male connector 110 are also located in the control pocket 94 to facilitate recharging of the battery pack 36. As shown schematically in FIG. 6, a transformer 118 having a plug 120 for connection to a 110-220 Volt 50-60 cycle power source and a male connector 122 may be plugged into the female connector 38 of the battery pack 36 after removing the male connector 110 therefrom to recharge the battery pack 36. After charging the battery pack 36, the male connector 122 is removed from the female connector 38, and the female connector 38 is plugged back into the male connector 110.

The portable heated stadium seat 20 is preferably made in a size which will be accommodated on the seating area of any stadium. Typically, the width of the portable heated stadium seat 20 will be approximately sixteen inches, a size which will be accommodated readily since most stadiums allow at least that width for each seat, even on bleachers (the portable heated stadium seat 20 is shown in FIG. 1 resting on a bleacher 124). The depth of the seat member 22 is typically approximately thirteen inches, and the height of the backrest member 24 is typically approximately 17 inches.

Figure 7:
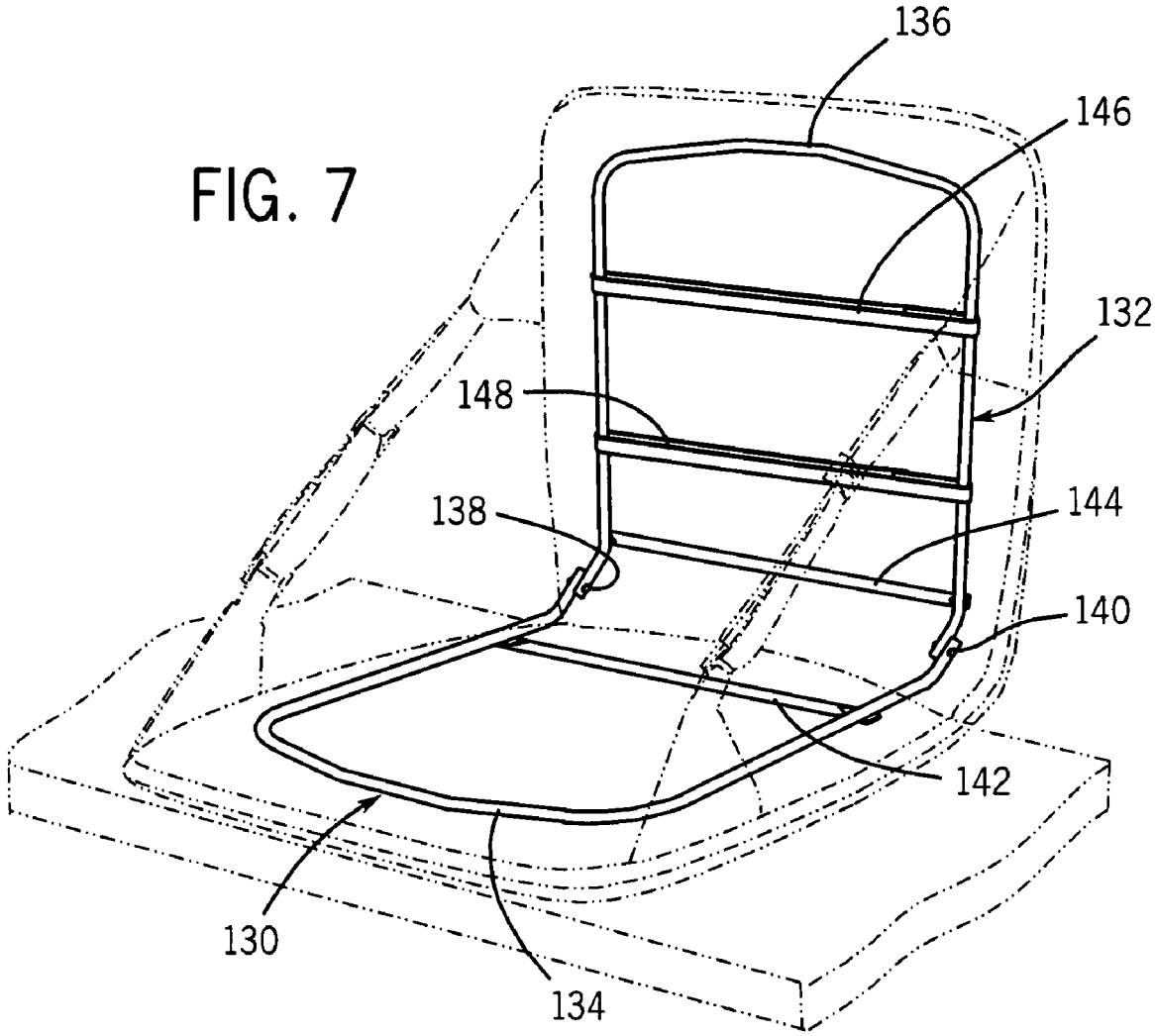
FIG. 7 is an isometric view of a tubular aluminum frame shown from the front and left side thereof in its opened position, with the external portions of the portable heated stadium seat and a bleacher being shown in phantom lines.

Referring finally to FIG. 7, a second embodiment of a frame is shown which may be used instead of the first embodiment illustrated in FIGS. 1 through 5. This embodiment uses thin, lightweight aluminum tubing to form a seat frame member 130 and a backrest frame member 132. The seat frame member 130 is formed of a U-shaped tubular segment 134, and the backrest frame member 132 is formed of a U-shaped tubular segment 136. The distal ends of the U-shaped tubular segment 134 on the right and left sides of the seat frame member 130 are respectively pivotally connected to the distal ends of the U-shaped tubular segment 136 on the right and left sides of the backrest frame member 132 with pins 138 and 104, respectively. It will be appreciated by those skilled in the art that the distal ends of the U-shaped tubular segments 134 and 136 are angled so that when the backrest frame member 132 is folded down onto the seat frame member 130, they will be spaced apart sufficiently to allow for the other components of the portable heated stadium seat 20 to fit therebetween.

A crossmember 142 extends between the legs of the seat frame member 130 at locations near to the angled distal portions thereof. Similarly, a crossmember 144 extends between the legs of the backrest frame member 132 at locations near to the angled distal portions thereof. Also located on the backrest frame member 132 are two backrest support bands 146 and 148, which are spaced apart and which extend around the legs of the U-shaped tubular segment 136. The backrest support bands 146 and 148, which may be made of durable fabric such as nylon, serve to provide additional support in the backrest member 24 of the portable heated stadium seat 20. Although not shown herein, similar support bands could also be used if desired on the seat frame member 130. It should be noted that this second embodiment of the frame of the portable heated stadium seat of the present invention is the preferred embodiment.

It may therefore be appreciated from the above detailed description of the preferred embodiment of the present invention that it teaches a portable heated stadium seat that includes both a heated seat member and a heated backrest member. The degree of heating in the seat member and the backrest member of the portable heated stadium seat of the present invention is consistent and thus does not begin operation at a high level of temperature and subsequently and continually decline in temperature over time. Heat is generated in the seat member and the backrest member of the portable heated stadium seat of the present invention by a self-contained rechargeable electrical power source rather than by an external power source.

The portable heated stadium seat of the present invention utilizes a rechargeable electrical power source which is reusable on a large number of occasions and which thereby does not require replacement. The portable heated stadium seat of the present invention is both foldable and lightweight to thereby make it easily portable as well as commercially desirable. The portable heated stadium seat of the present invention has a configuration which works well both on bleachers and on molded hard plastic seats.

The portable heated stadium seat of the present invention is of a construction which is both durable and long lasting, and which will require little or no maintenance to be provided by the user throughout its operating lifetime. The portable heated stadium seat of the present invention is also of inexpensive construction to enhance its market appeal and to thereby afford it the broadest possible market. Finally, all of the aforesaid advantages and objectives of the portable heated stadium seat of the present invention are achieved without incurring any substantial relative disadvantage.

Although the foregoing description of the portable heated stadium seat of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A portable heated stadium seat comprising:

a substantially rigid seat member;

a first electrically-operated heating element permanently positioned inside said seat member, said first heating element configured to directly generate heat within said seat member;

a contoured backrest member connected to said seat member, said backrest member being moveable between a first position wherein said backrest member is folded onto said seat member and a second position in which said backrest member extends generally upwardly from said seat member;

a second electrically-operated heating element permanently positioned inside said backrest member, said second heating element configured to directly generate heat within said backrest member;

an internally mounted electrical power source comprising a rechargeable battery pack;

an on/off switch for electrically connecting said electrical power source to said first and second electrically-operated heating elements to heat said seat member and said backrest member; and a fabric enclosure completely encasing said seat member and said backrest member.

2. A portable heated stadium seat as defined in claim 1, wherein said seat member comprises:

a substantially rigid seat frame member;

and wherein said backrest member comprises:

a substantially rigid, contoured backrest frame member.

3. A portable heated stadium seat as defined in claim 2, additionally comprising:

a hinge member connecting said seat frame member and said backrest frame member to allow said backrest frame member to pivot with respect to said seat frame member.

4. A portable heated stadium seat as defined in claim 2, additionally comprising:

a first foam cushion located intermediate said seat frame member and said first electrically-operated heating element; and a second foam cushion located intermediate said backrest frame member and said second electrically-operated heating element.

5. A portable heated stadium seat as defined in claim 4, additionally comprising:

a first thin pad located intermediate said first electrically-operated heating element and said first foam cushion; and a second thin pad located intermediate said second electrically-operated heating element and said second foam cushion.

6. A portable heated stadium seat as defined in claim 4, additionally comprising:

a first thin cushion located on a side of said first electrically-operated heating element opposite said first foam cushion; and a second thin cushion located on a side of said second electrically-operated heating element opposite said second foam cushion.

7. A portable heated stadium seat as defined in claim 6, additionally comprising:

a third thin cushion located on the side of said seat frame member opposite said first foam cushion; and a fourth thin cushion located on the side of said backrest frame member opposite said second foam cushion.

8. A portable heated stadium seat comprising:

a seat member including a substantially rigid seat frame member;

a first electrically-operated heating element located in said seat member;

a backrest member connected to said seat member, said backrest member including a substantially rigid backrest frame member; said backrest member being moveable between a first position wherein said backrest member is folded onto said seat member and a second position in which said backrest member extends generally upwardly from said seat member;

a second electrically-operated heating element located in said backrest member;

an electrical power source; and an on/off switch for electrically connecting said electrical power source to said first and second electrically-operated heating elements to heat said seat member and said backrest member;

a first foam cushion located intermediate said seat frame member and said first electrically-operated heating element; and a second foam cushion located intermediate said backrest frame member and said second electrically-operated heating element;

a front cover segment which is located on a side of said first and second foam cushions which are opposite said seat frame member and said backrest frame member, respectively; and a rear cover segment which is located on a side of said seat frame member and said backrest frame member which are opposite said first and second foam cushions, respectively, said front and rear cover segments being sewn together at an adjoining edge to fully enclose said first and second foam cushions, said seat frame member, and said backrest frame member.

9. A portable heated stadium seat as defined in claim 1, additionally comprising:

support members which limit the maximum angle to which said backrest member can be opened with respect to said seat member when said backrest member is in said second position.

10. A portable heated stadium seat as defined in claim 9, wherein said support members comprise:

a first support strap extending between a corner of said seat member opposite said seat member's point of connection to said backrest member and on a right side of said portable heated stadium seat and a corner of said backrest member opposite backrest member's point of connection to said seat member and on said right side of said portable heated stadium seat; and a second support strap extending between a corner of said seat member opposite said seat member's point of connection to said backrest member and on a left side of said portable heated stadium seat and a corner of said backrest member opposite backrest member's point of connection to said seat member and on said left side of said portable heated stadium seat.

11. A portable heated stadium seat as defined in claim 10, wherein the lengths of said first and second support straps are adjustable to adjust the maximum angle to which said backrest member can be opened with respect to said seat member when said backrest member is in said second position.

12. A portable heated stadium seat as defined in claim 1, additionally comprising:

a fastening member for releasably retaining said backrest member in said first position with respect to said seat member.

13. A portable heated stadium seat as defined in claim 1, additionally comprising:

a carrying member for supporting said portable heated stadium seat to transport it when said portable heated stadium seat is in said first position.

14. A portable heated stadium seat as defined in claim 13, wherein said carrying member comprises:

a support strap having an adjustable length.

15. A portable heated stadium seat as defined in claim 1, wherein said rechargeable battery pack comprises:

a plurality of nickel-cadmium batteries.

16. A portable heated stadium seat as defined in claim 1:

wherein said electrical power source is connected to at least one of a first and a second electrical connector and wherein a circuit including said first and second electrically-operated heating elements is connected to said second electrical connector, said first and second electrical connectors being selectively connectable to place said portable heated stadium seat into an operable state.

17. A portable heated stadium seat comprising:

a seat member;

a first electrically-operated heating element located in said seat member;

a backrest member connected to said seat member, said backrest member being moveable between a first position wherein said backrest member is folded onto said seat member and a second position in which said backrest member extends generally upwardly from said seat member;

a second electrically-operated heating element located in said backrest member;

an electrical power source;

an on/off switch for electrically connecting said electrical power source to said first and second electrically-operated heating elements to heat said seat member and said backrest member, wherein said electrical power source is connected to a first electrical connector, and wherein a circuit including said first and second electrically-operated heating elements is connected to a second electrical connector, said first and second electrical connectors being selectively connectable to place said portable heated stadium seat into an operable state; and an electrical power supply for recharging said electrical power source, said electrical power supply being connected to a third electrical connector, said third electrical connector being selectively connectible to said first electrical connector but not to said second electrical connector.

18. A portable heated stadium seat as defined in claim 17, additionally comprising:

a control pocket located on one of said seat member and said backrest member, said first and second electrical connectors and said on/off switch being located in said control pocket.

19. A portable heated stadium seat comprising:

a seat member;

a first electrically-operated heating element located in said seat member;

a backrest member connected to said seat member, said backrest member being moveable between a first position wherein said backrest member is folded onto said seat member and a second position in which said backrest member extends generally upwardly from said seat member;

a second electrically-operated heating element located in said backrest member;

an electrical power source;

an on/off switch for electrically connecting said electrical power source to said first and second electrically-operated heating elements to heat said seat member and said backrest member; and a pressure switch for electrical connection with said on/off switch, said electrical power source, and said first and second electrically-operated heating elements, said pressure switch being mounted in said seat member, said pressure switch being operable to deenergize said first and second electrically-operated heating elements when they would otherwise be energized if a user is not sitting on said seat member.

20. A portable heated stadium seat as defined in claim 1, additionally comprising:

a thermostat for electrical connection with said on/off switch, said electrical power source, and said first and second electrically-operated heating elements, said thermostat being mounted in one of said seat member and said backrest member, said thermostat being operable to deenergize said first and second electrically-operated heating elements when they would otherwise be energized when the temperature in said one of said seat member and said backrest member climbs to a first temperature, and said thermostat subsequently being operable to reenergize said first and second electrically-operated heating elements when they would otherwise be energized when the temperature in said one of said seat member and said backrest member drops to a second temperature lower than said first temperature.

21. A portable heated stadium seat as defined in claim 20, wherein said first temperature comprises:

approximately fifty-five degrees Centigrade;

and wherein said second temperature comprises:

approximately forty degrees Centigrade.

22. A portable heated stadium seat as defined in claim 1, additionally comprising:

a storage pocket located on one of said seat member and said backrest member.

23. A portable heated stadium seat as defined in claim 22, wherein said storage pocket comprises:

a mesh pocket made of elastomeric mesh which will expand and contract as needed to securely hold objects therein.

24. A portable heated stadium seat as defined in claim 1, additionally comprising:

a logo located on at least one of said seat member and said backrest member, said logo comprising at least one of a sports team name and a sports team logo.

25. A portable heated stadium seat comprising:

a substantially rigid seat member including a first electrically-operated heating element permanently mounted inside said seat member;

a contoured backrest member including a second electrically-operated heating element permanently mounted therein and including an internally mounted, rechargeable battery pack; said backrest member hingedly connected to said seat member by at least one hinge element;

a fabric enclosure entirely covering both of said seat and back rest members, said backrest member being moveable between a first position wherein said backrest member is folded onto said seat member and a second position in which said backrest member extends generally upwardly from said seat member;

support members which limit the maximum angle to which said backrest member can be opened with respect to said seat member when said backrest member is in said second position;

a thermostat mounted in one of said seat member and said backrest member, said thermostat being electrically conductive when the temperature in said one of said seat member and said backrest member climbs to a first temperature, and said thermostat subsequently becoming not electrically conductive when the temperature in said one of said seat member and said backrest member drops to a second temperature lower than said first temperature; and an on/off switch, wherein said rechargeable battery pack, said pressure switch, said thermostat, and said on/off switch are in a series circuit with said first and second electrically-operated heating elements.

26. A portable heated stadium seat comprising:

a substantially rigid seat member;

a first heating element permanently mounted inside said seat member;

a substantially rigid backrest member;

a hinge element connecting said seat member and said backrest member, the hinge having a first portion centrally mounted at a rear edge of said seat member and a second portion centrally mounted at a bottom edge of said backrest member;

a second heating element permanently mounted inside said backrest member;

an internally located power source comprising a rechargeable battery pack; and a mechanism to selectively actuate said power source to cause said first and second heating elements to heat said seat member and said backrest member.

27. A method of making a portable heated stadium seat, said method comprising:

providing a substantially rigid seat member;

permanently mounting a first electrically-operated heating element located in said seat member, said first heating element designed to directly heat said seat member;

providing a substantially rigid, contoured backrest member hingedly connected to said seat member by at least one hinge, said backrest member being moveable between a first position wherein said backrest member is folded onto said seat member and a second position in which said backrest member extends generally upwardly from said seat member;

permanently mounting a second electrically-operated heating element located in said backrest member said second heating element designed to directly heat said seat member;

mounting an electrical power source inside one of said seat member and said backrest member, said power source comprising a rechargeable battery pack;

providing a switch for electrically connecting said electrical power source to said first and second electrically-operated heating elements to heat said seat member and said backrest member; and completely enclosing said seat member and said backrest member.

* * * * *